United States Patent [19]

Yamatani

[11] Patent Number: 4,472,111

[45] Date of Patent: Sep. 18, 1984

[54] APPARATUS FOR GENERATING HIGH PRESSURE FLUID

[76] Inventor: Yoshiichi Yamatani, 1870 Manazuru, Manazuru-machi, Ashigarashimogun, Kanagawa-ken, Japan

[21] Appl. No.: 373,446

[22] Filed: Apr. 30, 1982

[30] Foreign Application Priority Data

Jan. 22, 1982 [JP] Japan ..... 57-008634

[51] Int. Cl.[3] ..... F04B 49/10; B60T 17/22; F01B 31/10

[52] U.S. Cl. ..... 417/1; 417/274; 417/63; 60/594; 60/534; 92/153; 92/86.5; 92/5 R; 184/29; 184/7.4

[58] Field of Search ..... 60/583, 534, 562, 589; 92/153, 86.5, 5 R, 134, 143; 417/568, 274; 91/46; 184/6.1, 29, 7 D, 7 E, 7 F, 28, 6.4

[56] References Cited

U.S. PATENT DOCUMENTS

| | | | |
|---|---|---|---|
| 1,857,750 | 5/1932 | Wilbur | 92/143 |
| 2,612,116 | 9/1952 | Lowther, Sr. | 92/86.5 |
| 2,739,643 | 3/1956 | Voit et al. | 417/274 |
| 2,984,211 | 5/1961 | Schneider | 92/143 |
| 3,095,785 | 7/1963 | Cahill | 92/5 R |
| 3,130,818 | 4/1964 | Smith et al. | 91/46 |
| 3,983,958 | 10/1976 | Swearingen | 184/28 |
| 4,271,671 | 6/1981 | Smeets | 60/589 |
| 4,364,452 | 12/1982 | Crago | 184/7 E |
| 4,382,364 | 5/1983 | Thomas et al. | 60/562 |
| 4,384,510 | 5/1983 | Frey | 92/86.5 |

FOREIGN PATENT DOCUMENTS

| | | | |
|---|---|---|---|
| 0988366 | 5/1976 | Canada | 92/86.5 |

*Primary Examiner*—Robert E. Garrett
*Assistant Examiner*—H. Edward Li
*Attorney, Agent, or Firm*—Weiser & Stapler

[57] ABSTRACT

The present invention comprises an apparatus for producing high pressure fluid by means of a cylinder having a reciprocatingly sliding ram inside, suction and pressurization of the fluid being performed by the reciprocation of said ram. In the apparatus, an oil chamber is positioned on the intensifying side within said cylinder, and lubricating oil in said oil chamber is caused to have a pressure equivalent to that of the high pressure fluid produced. This oil pressure is transmitted to the slidable contact portions of the ram. The apparatus is capable of detecting the lack of lubricating oil, when such lack of lubricating oil occurs.

4 Claims, 2 Drawing Figures

APPARATUS FOR GENERATING HIGH PRESSURE FLUID

BACKGROUND OF THE INVENTION

The present invention relates to an apparatus for producing high pressure fluid by means of a cylinder having a reciprocatingly sliding ram inside, suction and pressurization of the fluid being performed by the reciprocation of said ram.

Hitherto, various apparatuses have been included in apparatus for generating high pressure fluid by utilizing the reciprocation of ram. For example, apparatus as shown in Japanese Patent Application No. 53-85426 and the like are known. To make the apparatus operate efficiently and smoothly, due consideration also should be given to appropriate maintenance of the lubricating oil on the ram slidable contact portions of the ram, and to prevention of leakage of the high pressure fluid which is produced.

For that reason, as shown in Japanese Patent Application No. 54-166209, a pressurized feed oil tank is installed in novel manner, and provision has also been made that the produced high pressure fluid and lubricating oil at equivalent pressure be supplied from said tank to the slidable contact portions of the ram.

SUMMARY OF THE INVENTION

It is a principal object of the present invention to provide a supply of produced high pressure fluid, and lubricating oil at equivalent pressure, to the slidable contact portions of said ram, and simultaneously to prevent leakage of high pressure fluid, and to provide stopping the operation of the high pressure fluid producing apparatus in response to lack of lubricating oil. This protects the apparatus and prevents the occurrence of an accident when lubricating oil is lacking in the apparatus for producing high pressure fluid by reciprocation of the ram which is included within the cylinder, as above-mentioned.

The present invention is characterized in that an oil chamber is positioned on the intensifying side within said cylinder, lubricating oil in said oil chamber is caused to have a pressure equivalent to that of the generated high pressure fluid. This pressure is transmitted to the slidable contact portions of the ram. The apparatus is capable of detecting the lack of lubricating oil when that occurs, in the apparatus for producing high pressure fluid by reciprocation of the ram which is included within the cylinder.

BRIEF DESCRIPTION OF THE DRAWINGS

In the several views provided, like reference numerals denote similar structure.

DESCRIPTION OF THE PREFERRED EMBODIMENT

Figures 1, 2:
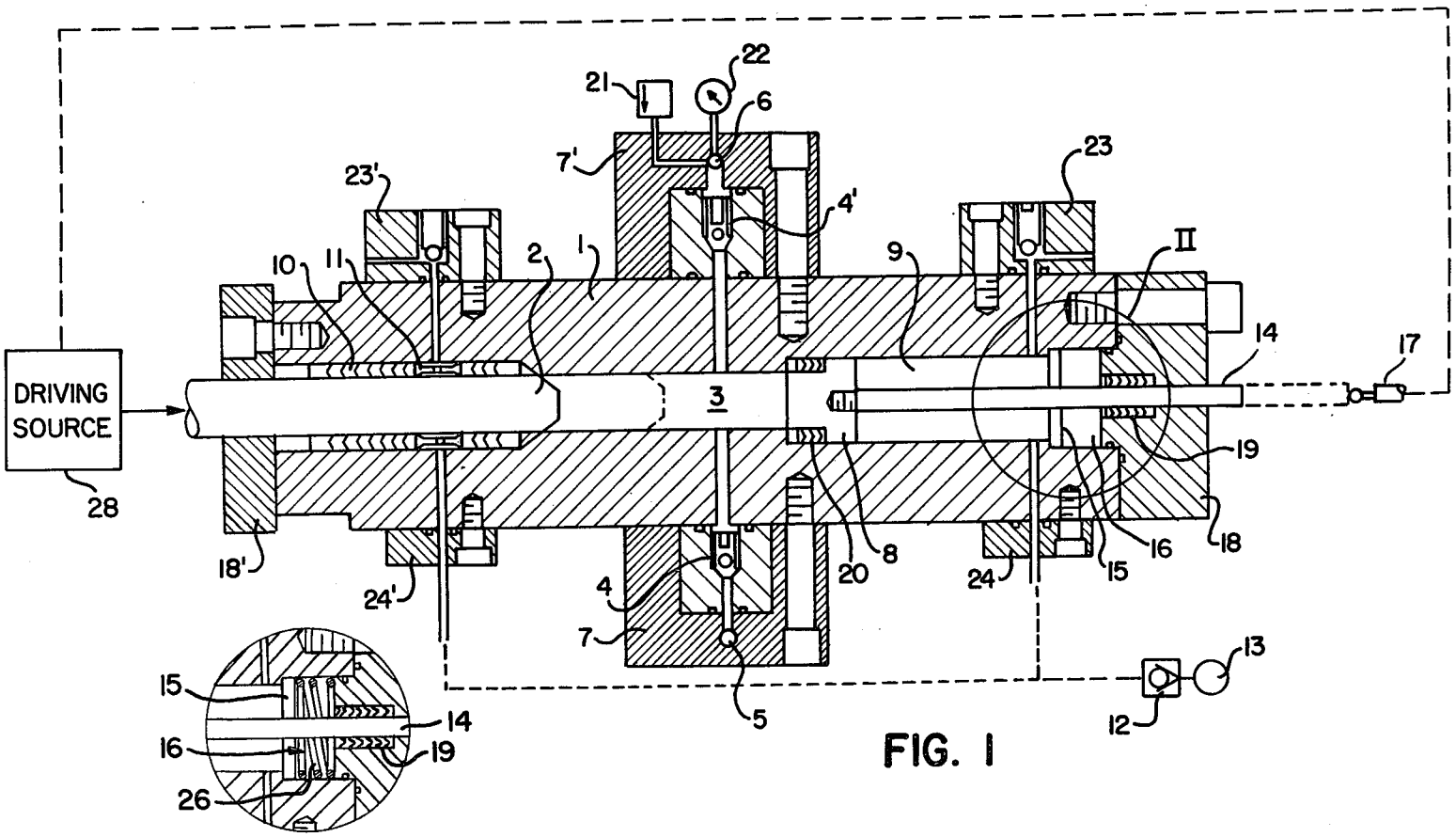
FIG. 1 is a sectional view of the essential elements illustrating an embodiment of the present invention.
FIG. 2 is a fragmentary, sectional view of portions of the embodiment illustrated in FIG. 1, at II, showing an alternative embodiment arrangement in accordance with the present invention.

Referring to the embodiment of the present invention with reference to the drawing, numeral 1 designates a cylinder including a ram 2 within said cylinder. An inflow port 5 of the fluid is connected through a check valve 4 and a discharge port 6 of high pressure fluid is connected through a check valve 4' to the intensifying chamber 3 respectively, and these ports are fixedly attached by flanges 7 and 7'. Further, the intensifying chamber 3 in the cylinder 1 is coupled with a first oil chamber 9 through a piston 8. This first oil chamber 9 is connected with a second oil chamber 11, which is formed on the slidable contact portions of ram 2 in the cylinder 1 by interposing a packing 10. Together, these oil chambers are connected to a feed pump 13 of lubricating oil through a check valve 12. Also, the piston 8 is provided with a detecting rod 14, and this detecting rod 14 is capable of projecting outside cylinder 1 by passing through said cylinder.

In addition, a movable partition 15 traversed by the detecting rod 14 is arranged within the first oil chamber 9, and the side opposite the piston 8 is constituted as a buffer chamber 16. Oil, preferably a high viscosity oil such as grease, may be received, or a spring 26 (FIG. 2) may be arranged in this buffer chamber 16. Also, a limit switch 17 is placed in a detecting position opposite the detecting rod 14 which is attached to piston 8 and is capable of projecting outside the cylinder 1. This limit switch 17 may be connected to a driving source 28 for the ram 2, so as to stop said driving source for the ram 2.

In the drawing, numerals 18 and 18' designate flanges at the ends of the cylinder 1, numeral 19 designates a packing arranged on the slidable contact portions of the flange 18 and the detecting rod 14, numeral 20 designates a packing arranged on the slidable contact portions of the piston 8 and the first oil chamber 9, numeral 21 designates a pressure regulating valve arranged at the discharge port 6 of high pressure fluid, numeral 22 designates a pressure gauge, numerals 23 and 23' designate air vent flanges which communicate with the first oil chamber 9 and the second oil chamber 11, respectively, and numerals 24 and 24' designate feed oil flanges which communicate with the first oil chamber 9 and the second oil chamber 11, respectively.

Describing now the operation of the apparatus, the ram 2 reciprocates and slides within the cylinder 1, a fluid is supplied (sucked) from the inflow port 5 into the intensifying chamber 3. This fluid flows out of the discharge port 6 as a high pressure fluid, and simultaneously the high pressure fluid presses against the piston 8. The pressure of the lubricating oil in the first oil chamber 9, which is supplied by the feed oil pump 13, becomes equal to the pressure of the high pressure fluid, due to the pressure of the piston 8. The pressure of the lubricating oil supplied to the second oil chamber 11, connected with this first oil chamber 9, also becomes equal to said pressure of the high pressure fluid. As a result, the sliding of the ram 2 becomes smooth, and simultaneously leakage of the high pressure fluid from the slidable contact portions is prevented.

Also, when the lubricating oil becomes insufficient due to leakage and the like, the displacement of the piston 8 inherently increases and, since the detecting rod 14 then projects outside the cylinder 1 as shown in broken lines, a driving source for the ram 2 stops in response to detection of this projection of the detecting rod 14, and the operation of the entire apparatus likewise stops.

Further, when the limit switch 17 is installed, the detecting rod 14 can cause the driving source for the ram 2 to stop automatically in response to coming into contact with this limit switch.

As mentioned above, in the present invention, the intensifying side of the cylinder, which produces a high pressure fluid by reciprocating and sliding of the ram, performs the added function of raising the pressure of lubricating oil automatically to the pressure equivalent to that of the high pressure fluid which is produced. Accordingly, the lubricating oil is automatically supplied to the slidable contact portions of the ram in a very rational manner, operation of the apparatus takes place efficiently and smoothly, and leakage of the high pressure fluid is simultaneously prevented. Moreover, when there is insufficient lubricating oil such lack of lubricating oil is quickly detected, and operation of the entire apparatus stops. Thus protection of the apparatus is provided and the occurrence of an accident can be forestalled, whereby, the present invention confers many advantages, such as the above.

What is claimed is:

1. In an apparatus for producing high pressure fluid by reciprocation of a ram which is enclosed within a cylinder, said apparatus being characterized in that an intensifying chamber in said cylinder is coupled with a first lubricating oil chamber through a piston, said first oil chamber is connected with a second lubricating oil chamber that is formed in the slidable contact portions of said ram in said cylinder, both oil chambers are connected with a feed pump of the lubricating oil through a check valve, a detecting rod which is capable of projecting outside said cylinder is attached to said piston, and said first oil chamber is divided by a movable partition, wherein the side remote from said piston becomes a buffer chamber.

2. An apparatus for producing high pressure fluid according to claim 1, wherein a high viscosity oil is received within said buffer chamber.

3. An apparatus for producing high pressure fluid according to claim 1, wherein a spring is arranged within said buffer chamber.

4. An apparatus for generating high pressure fluid according to claims 1, 2, or 3, wherein a limit switch is arranged in detecting position confronting said detecting rod, and said limit switch is connected with the driving source for said ram so as to stop said driving source.

* * * * *